US007770316B2

(12) United States Patent
Meyerle

(10) Patent No.: US 7,770,316 B2
(45) Date of Patent: Aug. 10, 2010

(54) APPARATUS AND METHOD FOR SECURING FIREARMS AND CARTRIDGES

(75) Inventor: Herbert Meyerle, Maisach (DE)

(73) Assignee: Armatix GmbH, Unterfohring (DE)

( * ) Notice: Subject to any disclaimer, the term of this patent is extended or adjusted under 35 U.S.C. 154(b) by 1141 days.

(21) Appl. No.: 10/537,978

(22) PCT Filed: Sep. 12, 2003

(86) PCT No.: PCT/EP03/10180

§ 371 (c)(1),
(2), (4) Date: Jun. 9, 2005

(87) PCT Pub. No.: WO2004/053422

PCT Pub. Date: Jun. 24, 2004

(65) Prior Publication Data

US 2006/0117632 A1 Jun. 8, 2006

(30) Foreign Application Priority Data

Dec. 11, 2002 (DE) ..... 102 57 901

(51) Int. Cl.
*F41A 17/00* (2006.01)

(52) U.S. Cl. ..... 42/70.01; 102/202.5; 102/472

(58) Field of Classification Search ..... 102/202.5, 102/472; 42/70.01

See application file for complete search history.

(56) References Cited

U.S. PATENT DOCUMENTS

| | | | | |
|---|---|---|---|---|
| 3,745,925 A | | 7/1973 | Hester, Jr. | 102/70.2 |
| 4,150,624 A | * | 4/1979 | Hammond | 102/293 |
| 4,848,233 A | | 7/1989 | Dow et al. | 102/202.2 |
| 5,301,448 A | * | 4/1994 | Petrick et al. | 42/70.01 |
| 5,303,495 A | * | 4/1994 | Harthcock | 42/84 |
| 5,485,786 A | * | 1/1996 | Hesse et al. | 102/202.5 |
| 5,625,972 A | * | 5/1997 | King et al. | 42/84 |
| 6,189,430 B1 | | 2/2001 | Vornfett | 89/6.5 |

(Continued)

FOREIGN PATENT DOCUMENTS

DE 198 27 378 12/1999

(Continued)

OTHER PUBLICATIONS

International Search Report for PCT/EP2003/010180, issued by the European Patent Office in German.

*Primary Examiner*—J. Woodrow Eldred
*Assistant Examiner*—Gabriel J Klein
(74) *Attorney, Agent, or Firm*—Westman, Champlin & Kelly, P.A.

(57) ABSTRACT

The present invention relates to a method and an apparatus for firing a cartridge for firearms or a method and an apparatus for securing the firing of a cartridge for firearms. The present invention provides a cartridge comprising a securing mechanism. In a further preferred embodiment of the present invention, the firearm reads an identity from the cartridge and calculates a cartridge password from said identity together with further data. Said cartridge password is transmitted to the cartridge. The cartridge itself decides whether it fires or not.

Thus, the present invention provides apparatuses and methods with which a securing of a firearm against accidental and/or unauthorized use is provided. Furthermore, the apparatus and method according to the present invention not only allow a securing of the firearm, but also a securing of the cartridge against accidental, improper and/or unauthorized firing.

21 Claims, 2 Drawing Sheets

U.S. PATENT DOCUMENTS

| | | | | |
|---|---|---|---|---|
| 6,283,034 | B1 | 9/2001 | Miles, Jr. | 102/430 |
| 6,354,033 | B1 * | 3/2002 | Findley | 42/84 |
| 6,735,897 | B1 * | 5/2004 | Schmitter et al. | 42/70.01 |
| 6,760,992 | B2 | 7/2004 | Brosow | 42/70.06 |

FOREIGN PATENT DOCUMENTS

| | | | |
|---|---|---|---|
| DE | 100 18 369 | | 10/2001 |
| GB | 1 377 398 | A | 12/1974 |
| WO | WO 00/47942 | A | 8/2000 |
| WO | WO 01/79777 | A1 | 10/2001 |
| WO | WO 01/84069 | A1 | 11/2001 |

* cited by examiner

APPARATUS AND METHOD FOR SECURING FIREARMS AND CARTRIDGES

CROSS-REFERENCE TO RELATED APPLICATION

This Application is a Section 371 National Stage Application of International Application No. PCT/EP2003/010180, filed Sep. 12, 2003 and published as WO 2004/053422 A1 on Jun. 24, 2004, not in English, the contents of which are hereby incorporated by reference in their entirety.

FIELD OF INVENTION

The invention relates to a method and a device for firing a cartridge for firearms as well as a method and a device for securing the firing of a cartridge for firearms.

BACKGROUND OF THE INVENTION

Current systems or methods for firing cartridges for firearms or for securing firearms can generally be divided into various categories.

On the one hand, firearms can be secured by outer mechanisms and devices. These can be arranged lockably, for example, at the trigger of the firearm or within the cartridge chamber, so that the triggering of the trigger or the insertion of a cartridge is prohibited. Furthermore, firearms are stored for securing in specific firearm safes etc. Such measures usually serve for prohibiting an unauthorized use of the firearm(s).

On the other hand, firearms can be secured by internal mechanical securing mechanisms. Here, usually a mechanic mechanism prevents the going off of a shot, in that it inhibits a relevant movement with the firearm or the firearm's lock. For example, the triggering lever can be blocked from being pulled by a latch, which inhibits the biasing or releasing of the firing pin and, thus, the shot going off. The firing pin, too, can be arrested preferably in its unbiased position for securing, so that the firing pin is inhibited from hitting the percussion cap of a cartridge. A further possibility is to insert a block between firing pin and cartridge so that the firing pin cannot come into contact with the cartridge or the percussion cap. The securing mechanisms described afore are especially suitable for prohibiting that a shot is released accidentally or unintentionally but can also be used for prohibiting an unauthorized use.

Furthermore, firearms can be secured electronically. On the one hand this can be achieved by an electronic actuation of a mechanical latch, as described above, or on the other hand, in case of electronically ignited firearms, by blocking or interrupting the ignition circuit. The electronic securing provides generally the advantage that further securing measures can be integrated, which not only prohibit the accidental releasing of a shot but also the unauthorized use of a firearm.

U.S. Pat. No. 5,461,812 describes a method by which a firearm can only be brought from a secured into a ready-for-use condition by a confirmed registered signal. Here, the actuation of the trigger is only possible, if the correct identification signal has been transferred. Therefore, the system comprises microcircuits which are integrated into the firearm butt and a ring having a transponder which is worn on the hand used as firing hand of the user. When the firearm is taken up by the user, a transmitter is switched on by an switch located at the firearm's butt, the transmitter communicating with the transponder located at the finger ring. In case the data exchanged correspond to the expected data, a firing of the firearm is made possible.

DE 37 17 149 describes a detonator ignition element which is formed as a part of an integrated electronic circuit. Here, an explosive or a pyrotechnical compound is exposed to the impact of an energy released by the means. This means can be formed by a resistance, a semiconductor or a field effect means. The integrated circuit comprises clock, control, communication and blocking circuits in order to form an independent or computer controlled detonation system.

WO 01/79777 describes an electronic securing device of a firearm and respective electronically secured munitions. Here the firearm is secured against unauthorized use in that a releasing means is made up in such a manner that it is only released if a transponder to be worn by the user and to be requested by an electronic circuit of the firearm gives back a valid license code. Furthermore, munitions to be ignited electronically and a firearm suitable for using said munitions is suggested, wherein the firearms comprise a real-time clock so that time and date of each use of the firearm can be stored. Additionally, the munitions comprise a code identifying the kind of the munitions which is readable via an arrangement of contact by the firearm. Here, it can be prohibited, for example, that the firearm is fired using unsuitable munitions which might result in a dangerous barrel expanding.

The embodiments for securing firearms known from the prior art comprise various disadvantages. Thus, most systems only prohibit the unintentional going off of a shot. Furthermore, the known systems can only provide limited security against the unauthorized use of the firearm, since the blocking and deactivating mechanisms can be bypassed or set out of force. The known systems have furthermore the disadvantage that they cannot prohibit the use of the munitions. Said munitions can, for example, still be used or ignited by unauthorized persons, for example with a firearm which remains unsecured or cannot be secured. Additionally, there is the risk that the cartridge is ignited by outer impacts, for example by the impact of force or the admitting of mechanical or electrical energy which might happen unintentionally.

SUMMARY OF THE INVENTION

The present invention is thus based on the object to provide a method and an apparatus which overcome the disadvantages of the prior art. It is a further or alternative object of the present invention to provide a method and an apparatus with which a cartridge for firearms can be fired securely or which facilitates the secure ignition of such a cartridge. It is a further or alternative object of the present invention to provide a cartridge for firearms which can only be fired with a respective firearm and/or by an authorized user. Further objects of the present invention are to overcome further disadvantages of the prior art.

These objects are achieved with the features of the claims. The present invention starts off from the basic idea to provide a cartridge having a securing mechanism. A further basic idea of a preferred embodiment according to the present invention is that the firearm reads an identification, preferably an individual one, from the cartridge and calculates from this identification along with further data a cartridge password. The cartridge password is transferred to the cartridge. Then, it is the cartridge itself which decides whether it ignites or not.

In a preferred embodiment according to the present invention, the cartridge comprises an energy barrier which blocks the supply of energy for the ignition of the cartridge. This energy barrier can only be released by transmitting a release signal. This release signal is preferably transferred in form of a password.

In a further preferred embodiment according to the present invention, the cartridge comprises at least a memory in which the identification and the cartridge password are stored. Here, the storing is achieved in such a manner that the identification can be read out while the cartridge password itself cannot be read out and is used by the cartridge only for comparing the received password. For the use of the cartridge the identification is read out and is calculated to the cartridge password by means of an algorithm. This cartridge password is transferred to the cartridge and is compared with the stored cartridge password by the cartridge. In case the stored and the received cartridge password match with each other, the ignition of the cartridge is facilitated or allowed or initiated. The pairing of identification and cartridge password in the cartridge can be generated according to a preferred embodiment of the present invention by an arbitrary algorithm and password and can be individual for each cartridge. The adjustment can be made by the manufacturer, the trader etc. Even a belated change is possible provided that the correct password has been transferred to the cartridge.

As the cartridge does not need to calculate the algorithm it can have a quite simple design. The cartridge only compares the received with the stored password.

In a further preferred embodiment according to the present invention, the cartridge comprises or receives an additional identification of the purchaser, so that it can only be used by him/her. In a further embodiment of the present invention the cartridge facilitates a function check.

In a preferred embodiment of the present invention the apparatus for securing the firing of the cartridge is located within the percussion cap. This arrangement has, among others, the advantage that the cartridge itself need not to be changed or can be produced according to the known methods, while it is only the structure of the percussion cap which has to be adjusted.

Furthermore, an embodiment according to the present invention for firing a cartridge for firearms, which is arranged within the cartridge, preferably comprises an interface, which communicates with a corresponding interface of the firearm. Via this interface, data can be exchanged between cartridge and firearm. Furthermore, the apparatus preferably comprises an identification memory, in which the identification necessary for the calculation of the cartridge password is stored. In a further preferred embodiment, further data concerning the cartridge and/or the purchaser are stored in the identification memory.

Furthermore, the apparatus preferably comprises a means for checking the password, in which the cartridge password is stored. This storing of the cartridge password is preferably performed in a manner that it is secure against manipulation and reading. The means for checking the password compares the password received from the firearm with the stored one. If the received and the stored password match with each other, the ignition of the cartridge is made possible.

In a further preferred embodiment according to the present invention, the apparatus comprises an energy blocking means or energy barrier, which inhibits that the energy supplied to the cartridge, ignites said cartridge.

In a preferred embodiment, this energy barrier is designed to be secure against high electric energies like high voltage, high frequency etc. The blocking of the energy flow by the energy barrier is preferably reversed by a successful transmission and checking of the cartridge password.

Preferably, the apparatus within the cartridge is furthermore protected against attacks by electrical, mechanical, chemical, thermal energies and/or radiation. This is preferably achieved in that a certain amount of at least one of said energies destroys, preferably permanently, the capability of the cartridge to be fired.

In a further preferred embodiment the apparatus furthermore comprises a firing transducer which effects the transformation of electric energy into the preferably chemically stored energy of an firing load of the cartridge. Such a transformation is preferably achieved thermally, electrochemically, by radiation or further principles and methods known from the prior art. In a preferred embodiment of the present invention, the firing transducer ignites a pre-priming charge which in turn ignites the actual priming charge.

In a preferred embodiment of the present invention the energy barrier is located before the firing transducer so that the energy transmitted for firing can only reach the firing transducer via the energy blocking means. The energy blocking means preferably comprises a combination of securing elements, short cut elements, high voltage switches, dischargers or capacities. In a preferred embodiment the energy blocking means, as far as it is released, only allows the passage of energy in form of high frequencies.

The releasing of the energy barrier is achieved in a preferred embodiment by the means for checking the password, preferably after the successful comparison of the received with the stored password. In a further preferred embodiment, the firing transducer can be deactivated, e.g., by destruction.

A further apparatus according to the present invention for firing a cartridge for firearms is located within the firearm. Such an apparatus according to the present invention preferably comprises a cartridge interface for the communication with the cartridge. Via the cartridge interface, preferably cartridge data can be read, data can be transmitted to the cartridge and the firing energy can be transferred to the cartridge. The cartridge interface is preferably a serial electronic interface. Furthermore, the apparatus preferably comprises a control for the central flow control, for the coordination of all modules and/or for monitoring the operation conditions.

Furthermore, the apparatus preferably comprises a crypto-controller, which calculates the cartridge password using the cartridge identification. If further data, for example, a user-specific password, at least one user profile, user data and/or cartridge data, are necessary for the calculation of the cartridge password, these data are also integrated into the calculation. In a preferred embodiment of the present invention, the crypto-controller securely stores sensible data like, for example, a secret user-specific password against any kind of reading and manipulation. In a further preferred embodiment, the crypto-controller monitors time and any kind of other limitation in the use of the firearm.

In a preferred embodiment of the present invention, the apparatus furthermore comprises a trigger sensor, which detects, when a shot should be fired. The trigger sensor transmits the respective data preferably to the control. Furthermore the apparatus according to the present invention comprises a firing impulse generator which generates electric firing energy and provides the same for firing the cartridge.

In a further preferred embodiment according to the present invention, the apparatus preferably comprises a data interface, an authentication interface and/or a data memory. The data interface is preferably used for reading munitions data, reading data concerning the firearm's user and/or reading of firearm data. Transmission and data exchange are preferably performed without wiring, via memory cards and/or chip cards. The authentication interface serves for authentication of the firearm user. The authentication is preferably performed by means of a transponder, biometry, tip code, remote inquiry or the like. The data memory preferably serves for the storing cartridge data, the logging of all firearm activities and/or the logging of operation data. The storing of the data is preferably encoded. The data memory preferably stores firearm activities, like, for example, authentications or authentication attempts, activities of the data interface and/or firing of the firearm. Battery condition, impacts by mechanical blows, extreme temperatures and/or maintenance etc. belong to the regarded or stored data.

Furthermore, the apparatus according to the present invention makes possible the securing against accidental or unintentional firing of a shot. Here, the releasing of the cartridge and/or the transmission of the cartridge password can depend on the position of a mechanic securing lever or the like.

In further preferred embodiments according to the present invention a time-depending securing is also possible. Such an additional securing only allows the use of the firearm and/or the cartridge only at a certain time, for a certain period of time and/or during a certain time interval.

The present invention furthermore provides a method corresponding to the functions and functional relations.

BRIEF DESCRIPTION OF THE DRAWINGS

In the following the present invention is explained in detail by means of the drawings.

FIG. 1 shows an operation diagram of embodiments according to the present invention, wherein FIG. 1*a* shows a preferred embodiment of an apparatus being located within a firearm and FIG. 1*b* shows a preferred embodiment of an apparatus being arranged at a cartridge;

DETAILED DESCRIPTION OF THE PREFERRED EMBODIMENTS

Figures 1, 1A, 1B:
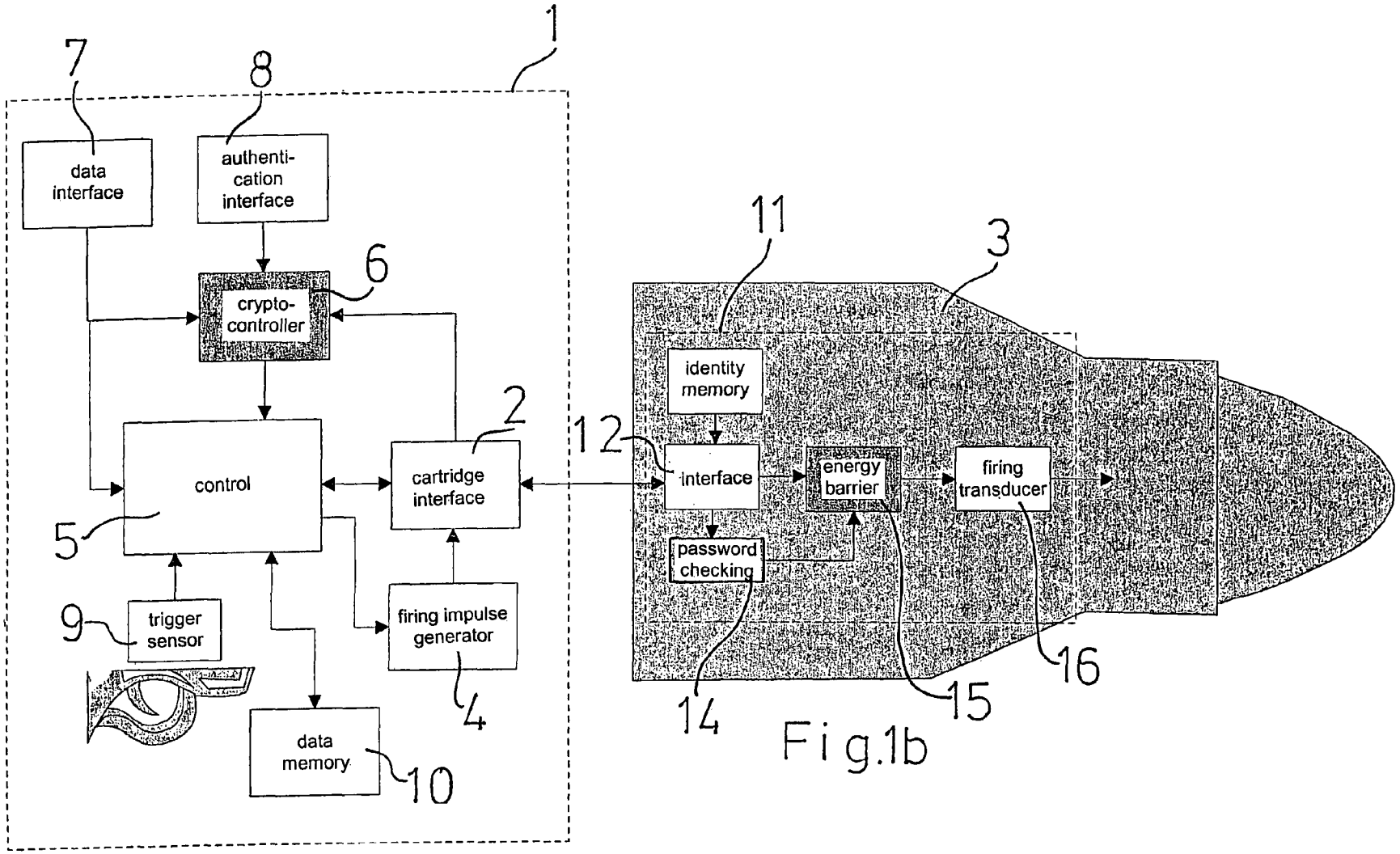

FIG. 1*a* shows an operation diagram of a preferred embodiment according to the present invention of an apparatus 1 being located within a firearm. The shown apparatus according to the present invention comprises a cartridge interface 2 for communicating with the cartridge 3 or with an apparatus 11 being located within the cartridge, the cartridge interface is preferably a serial electronic interface. By means of the cartridge interface 2, preferably cartridge data are read, data are transmitted to the cartridge 3 and/or the firing energy can be transferred to the cartridge 3. This firing energy being preferably electric energy, is generated by the firing impulse generator 4. Furthermore, the cartridge interface 2 exchanges data preferably with the control 5. The control 5 preferably serves for the central operation control as well as the coordination of all modules or apparatuses and the monitoring of the operation conditions. The cartridge interface 2 furthermore transmits the cartridge identity received from the cartridge to the crypto-controller 6 which calculates the cartridge password by means of the cartridge identity. Depending on the embodiment of the apparatus according to the present invention and/or the structure of the algorithm used for calculating the cartridge password, the cartridge password is additionally calculated on the basis of at least a user-specific password, at least one authorization profile, user data, position or location data, firearm data and/or cartridge data. For this purpose, the crypto-controller 6 receives and/or stores additional data which are transmitted to the crypto-controller via at least one data interface 7 or an authentication interface 8. Furthermore, the crypto-controller 6 stores preferably a user-specific password and other sensible data. The storing is preferably achieved securely against each kind of reading and manipulation. Furthermore, the crypto-controller 6 monitors preferably limitations in time and other limitations in the use of the firearm.

In a preferred embodiment according to the present invention the apparatus comprises a GPS-system or can be connected thereto, the GPS system detects location or position data and transmits these data to the crypto-controller 6 and/or the control 5.

The crypto-controller 6 preferably comprises a high security against manipulation and unauthorized reading of data. Here, preferably security relevant data like, for example, the algorithm, are protected against reading and manipulation. Preferably chips as, for example, used with smart-cards are applied.

The authentication interface 8 preferably serves to perform the authentication of the user. Such an authentication is preferably performed by means of a transponder available to or arranged at the user. In a further preferred embodiment, the authentication is performed by checking biometric data of the user, e.g., by means of biometric sensors and the like. For the authentication by biometric data, for example, a fingerprint or the like can be used. Preferably, identification is also performed by a voice check and the like. Further possibilities for the authentication are the input of a code or tip code or the remote inquiry. The data recorded by the authentication interface 8 are transmitted to the crypto-controller 6 which compares these data with stored data and/or uses these data for calculating the cartridge password.

Via the data interface 7, additional data can be entered into the apparatus. Here, the entering of the data can be performed without wiring, by memory cards, chip cards and/or sensors or the like. In a preferred embodiment according to the present invention, the data are entered via the data interface by means of a combination of the afore-mentioned and/or other ways. The data interface 7 preferably serves for the reading of data concerning the munitions, the user of the firearm and the firearm. The read data are transmitted to the crypto-controller 6 and/or the control 5. In a preferred embodiment of the present invention, the data interface 7 also serves for the export of data from the apparatus.

In a further preferred embodiment of the present invention, the crypto-controller 6 has such a structure that at least one part of the crypto-controller 6 is assigned to at least one user and/or that at least one part of the crypto-controller 6 is assigned to the munitions and/or that at least one part of the crypto-controller 6 is assigned to the firearm. The respective parts are such formed that they are interrelated to each other. Thus, for example, a certain firearm type is assigned to a user. Thus, the user is prohibited to use other firearms or firearm types.

In preferred embodiments, the described parts are structural parts, in a preferred embodiment interchangeable parts, of the crypto-controller 6, for example, a chip, or in form of a stored assignment which is achieved by means of data or password transmission or the like.

Furthermore, the apparatus comprises a trigger sensor 9 in a preferred embodiment, which detects depending on the operation of the trigger. When a shot should be fired. The trigger sensor 9 transmits the respective data to the control 5, which in turn initiates that firing energy generated by the firing impulse generator 2 is transmitted to the cartridge 3 via the cartridge interface 2. If the cartridge password is correctly determined, the cartridge 3 allows the firing so that a shot can be fired.

Furthermore, the apparatus comprises a data memory 10, which stores cartridge data, operation data and/or firearm activities as well as preferably their relation to each other. The storing of the data is preferably achieved via the control 5 in the embodiment shown. Furthermore, over the control the data can be preferably read via the data interface 7.

FIG. 1*b* shows a preferred embodiment according to the present invention in which an apparatus 11 is arranged within the cartridge 3. First, the apparatus 11 comprises an interface 12 which communicates with the firearm preferably with an interface or a cartridge interface 2 of a respective apparatus 1 located within the firearm. The interface 12 preferably reads the cartridge identification stored in an identification memory 13 and transmits said cartridge identification to the firearm or the apparatus 1 located within the firearm via the cartridge interface 2, here. Furthermore, the interface 12 receives the password calculated by the firearm or the apparatus 1 located within the firearm and transmits said password to a password checking means or a password checking 14. Within the password checking 14, the cartridge password is stored securely against manipulation and reading. The pass word checking 14 compares the received with the stored cartridge password. In case the passwords match, the password checking 14 releases an energy barrier 15, so that this allows that firing energy can reach the firing transducer 16. In case the received password does not match with the stored cartridge password, the password check 14 does not release the energy barrier 15, so that the ignition of the firing transducer 16 is inhibited.

In a preferred embodiment according to the present invention the energy barrier 15 is arranged directly in front of the firing transducer. In a further preferred embodiment according to the present invention, the energy barrier 16 is such integrated into the interface, that in the closed condition, it allows the data and the energy necessary for the data exchange to pass but not the energy necessary for the firing.

When the apparatus receives a firing energy or a firing impulse over the interface 12, the energy reaches the firing transducer 16 only via the energy barrier 15. The energy barrier 15 only allows that the firing energy reaches the firing transducer 16 as far as it was released by the password checking 14. The energy barrier 15 comprises preferably a combination of securing elements, short cut elements, high voltage switches, dischargers and/or capacities. In a preferred embodiment according to the present invention, the energy can only pass the energy barrier 15 in form of high frequency.

In a preferred embodiment according to the present invention, the energy barrier 15 inhibits manipulatively inserted electric energy or by passes said energy in such a manner that an unauthorized firing is impossible. The energy barrier comprises preferably at least one fusion element against manipulatively inserted energy which inhibits or blocks the current flow due to manipulatively inserted energy. In a further preferred embodiment, the energy barrier is formed such that the manipulatively inserted energy by-passes the firing transducer. Furthermore, the energy barrier is preferably such formed that it causes a permanent inactivation of the firing transducer due to manipulatively inserted energy.

When the energy barrier 15 is released, firing energy or a firing impulse can reach the firing transducer 16. Said firing transducer transforms the firing energy or the firing impulse, so that the stored energy of a priming charge is released. In a preferred embodiment of the present invention, the firing energy is electric and the stored energy of the priming charge is preferably chemical energy. The transformation of the firing energy is preferably achieved thermally, electrochemically or by radiation.

In a preferred embodiment of the present invention, the permanent destruction of the cartridge's capability to ignite is preferably effected if respective conditions occur. Here, it can be the impact of forces, attacks by mechanic, electric, chemical and thermal means, manipulation and firing attempts by electric energy and/or the like.

In a further preferred embodiment according to the present invention, a permanent destruction of the capability to fire the cartridge is achieved in that the carrier plate for electronic and firing apparatus is such arranged that it cannot be removed without destroying the percussion cap or itself, and that only the contacts are accessible from the outside and that the electric components are protectively arranged at the inner side. Furthermore, the percussion cap is connected to the cartridge in such a manner that it cannot be entirely removed and exchanged.

In a further preferred embodiment the identification memory 13 comprises further data concerning the cartridge like, e.g., the manufacturing date, the kind of priming charge, the projectile, the caliber etc.

In a preferred embodiment according to the present invention an apparatus according to FIG. 1*a* located within the firearm and an apparatus according FIG. 1*b* located within the cartridge are communicating. This communication is preferably effected via the cartridge interface 2 and the interface 12.

Figure 2:
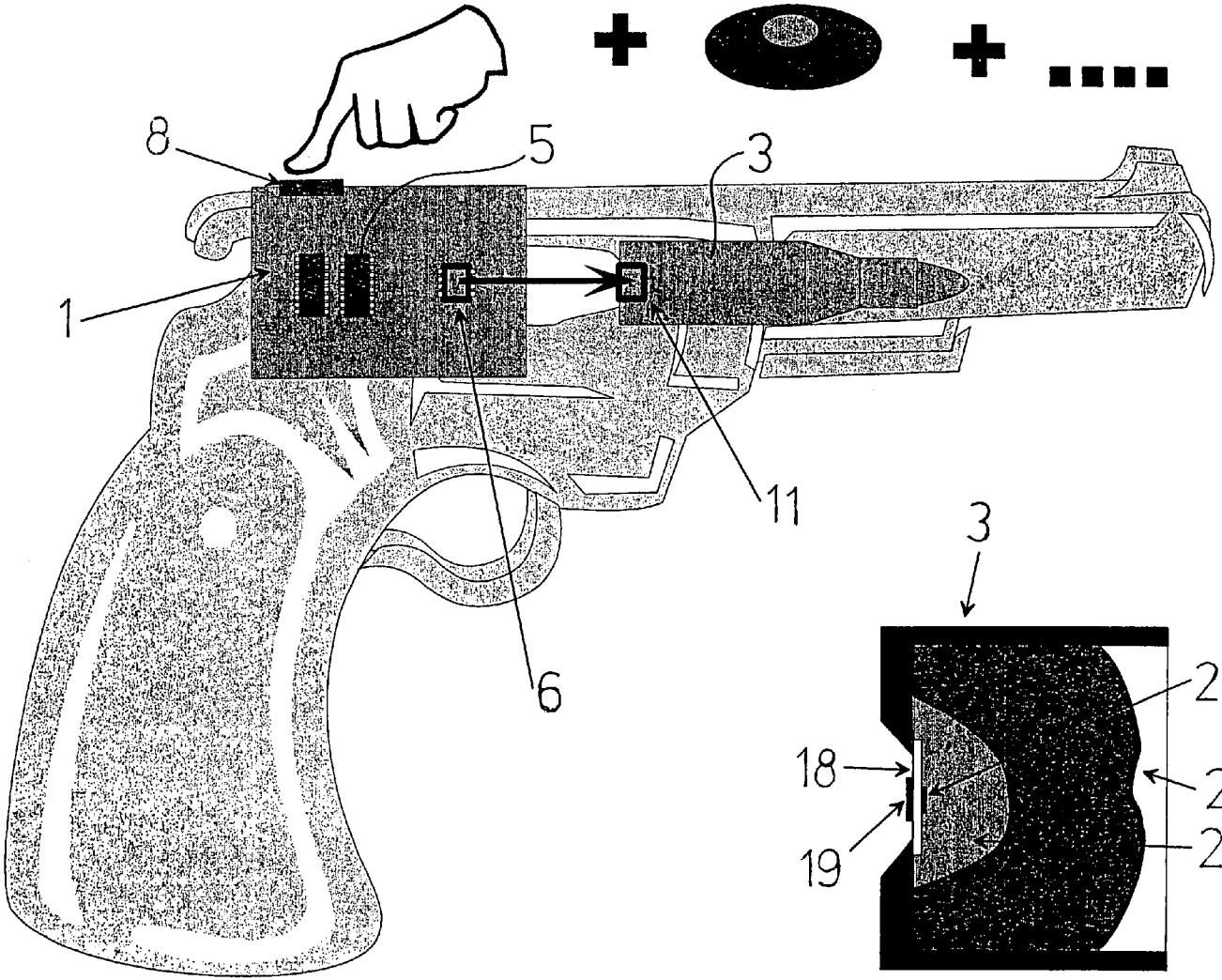
FIG. 2 shows an exemplary arrangement of two apparatuses according to the present invention in a firearm and their relation to each other.

FIG. 2 shows an apparatus according to the present invention consisting of an apparatus 1 according to the present invention located within the firearm and an apparatus 11 according to the present invention located within the cartridge. FIG. 2 shows a firearm 17 being a revolver in which a cartridge 3 ready to be shot is arranged. The cartridge 3 comprises an apparatus 11 according to the present invention. Furthermore the firearm 17 comprises an apparatus 1 according to the present invention having an authentication interface 8, crypto-controller 6, control 5 etc. As already described, the apparatus 1 receives a cartridge identification stored in the identification memory 13 of the cartridge 3 and calculates this in the crypto-controller 6 to receive the cartridge password. In order to perform the calculation or to receive the correct cartridge password further user-specific authentication and/or authorization profiles are necessary in the shown preferred embodiment according to the present invention. These data are integrated into the algorithm in a preferred embodiment. In this case, the cartridge 3 can only be used by a pre-determined user or a predetermined group of users, that is identified by means of certain features or data. In a further preferred embodiment according to the present invention, these data are necessary for performing the algorithm, i.e., they serve as additional securing or authorization requirement. Thus, the calculation of the cartridge password is only performed either when the authorized user is authenticated or the cartridge password is only correctly calculated when the necessary authentication data have been received. The authentication of the user is preferably performed over the authentication interface 8, which is a transponder interface and/or a biometric sensor etc. In a preferred embodiment according to the present invention, the apparatus 1 is formed such that multiple user data are necessary for authentication or that alternative authentication data can be used. The authentication interface 8 furthermore comprises multiple different authentication interfaces according to a preferred embodiment of the present invention.

When the cartridge identification has been read by the apparatus 1 located within the firearm, the user has been authenticated over the authentication interface 8 and/or the required data have been received via the data interface 7 and the cartridge password has been calculated and has been transmitted to the cartridge or the apparatus 11, a shot can be released. In preferred embodiments, the releasing of the cartridge 3 or the energy barrier 15 is performed by transmitting of the correct cartridge password prior to or with operating the trigger or transferring of the firing energy or the firing impulse.

In a preferred embodiment of the apparatus 1 located within the firearm or the apparatus 11 located within the cartridge 3, the crypto-controller 6 or the algorithm performed in said crypto-controller and/or the control 5 or the operation control of said control can be changed or newly programmed. Such amendments are preferably performed via the data interface 7 after the identification or authentication of the authorized user via the authentication interface 8. In a further embodiment according to the present invention the crypto-controller 6 or a part thereof can be interchanged or exchanged, like a SIM card in a mobile phone.

In a further preferred embodiment of the present invention, the cartridge password can be changed or can be adapted to a new algorithm or the like. Therefore, the password can be newly programmed by a respective read- and transmitting device. A prerequisite therefor, is first the correct transmission of the original cartridge password.

In a further embodiment of the present invention, the cartridge receives a buyer identification when it is bought, the buyer identification is stored in the identification memory 13 and is transmitted together with the cartridge identification to the firearm 17. The buyer identification can preferably be stored together with the afore-described data in the data memory 10 of the firearm over the control 5.

In a further embodiment of the present invention the cartridge can only be used in determined firearm types due to specific entries in the cartridge identification. Thus, it is possible to exclude automatic firearms.

Figure 3:
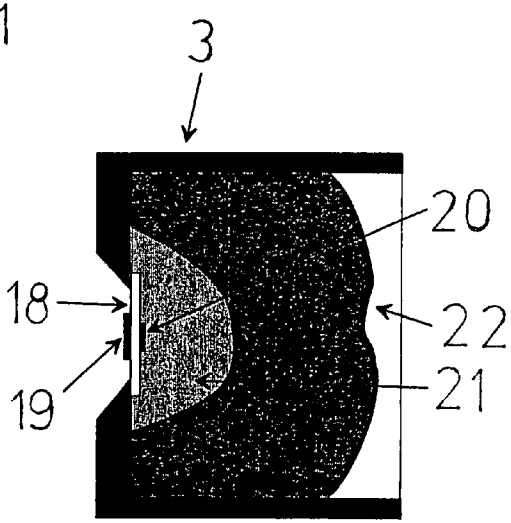
FIG. 3 shows a basic diagram of a detail of a cartridge for firearms, in which an apparatus according to the present invention is located.

FIG. 3 shows a preferred embodiment according to the present invention for the arrangement of the cartridge 3. In this preferred embodiment, the apparatus 11 is a percussion cap or integrated in said cap. FIG. 3 shows a preferred embodiment of the present invention of an apparatus 11 of the present invention being formed as a percussion cap, comprising a support 18, contacts 19 as well as a chip or microchip 20. The support 18 is such arranged at the bottom of a cartridge 15 that it covers an opening formed in the bottom of the cartridge 3. On the side of the support device 18 facing to the outside, the contacts 19 are arranged. The contacts 19 are part of the interface 12. On the side of the support device 18 facing to the interior of the cartridge microchip 20 is arranged, which comprises further elements or devices of the apparatus 11. The support device preferably comprises further elements like fuses and dischargers. When the correct cartridge password is transmitted and a firing impulse is transferred to the apparatus 11, the firing transducer 16 ignites a pre-priming charge 21 which in turn ignites the priming charge 22.

The afore-mentioned functions and functional relations described in relation to the description of the apparatus according to the present invention correspond to preferred embodiments of a method according to the present invention.

In a preferred embodiment of a method according to the present invention, the releasing of a secured cartridge is achieved by transmitting a password to the cartridge. In a further preferred embodiment, the cartridge password is calculated on the basis of an identification which can be read from the cartridge. In further preferred embodiments the releasing of the cartridge is achieved by the releasing of an energy barrier wherein the releasing is only performed with or after the transmitting of the correct cartridge password.

The present invention thus provides apparatuses and methods with which a securing of a firearm against accidental and/or unauthorized use is provided. Furthermore, the apparatus and the method according to the present invention do not only provide a securing of the firearm but also a securing of the cartridge itself against accidental, improper and/or unauthorized firing. The arrangement of the apparatus in the percussion cap furthermore facilitates a simple development and manufacturing as well as an easy fitting into existing cartridges or known cartridge versions, as the cartridge itself does not need to be amended.

By means of an apparatus according to the present invention or a method according to the present invention, the possibilities for attacks for a manipulation are extremely small and are transferred into an area, where a manipulation is quite difficult and even if this manipulation was successful this could only be used for a single shot. The securing mechanisms located within the firearm is preferably a crypto-controller which can be manufactured very economically while having a high security against manipulation. Here, chips can preferably be used like those used, e.g., in smart-cards. The method furthermore guarantees that neither the replacement of the crypto-controller nor its surroundings facilitates the unauthorized use of the firearm. Furthermore, using an apparatus according to the present invention or a method according to the present invention, the complexity of the circuits in the cartridge can be kept very small as no cryptography requiring complex calculation means is necessary in the cartridge.

Further advantages result from the overcoming of disadvantages of the prior art and result from the discussion above.

The invention claimed is:

1. A system for securing the firing of a shot from a firearm, comprising:

a cartridge with a device for enabling the firing of the cartridge, wherein the device is arranged within the cartridge, and a firearm with an apparatus for communication with the device of the cartridge, said apparatus being arranged within the firearm;

wherein said device arranged within the cartridge comprises:

a memory in which a cartridge identification and a separate cartridge password are stored, an interface for transmitting said cartridge identification to the apparatus which is arranged within the firearm and for receiving releasing data transmitted from said apparatus arranged within the firearm, a control means for comparing said cartridge password with the received releasing data, and a security means which is only releasable by a signal transmitted from the control means if the cartridge password and the received releasing data match, and wherein said apparatus arranged within the firearm comprises:

an operating device for calculating the releasing data on the basis of the cartridge identification, and a cartridge interface for communicating with the cartridge and for receiving the cartridge identification from the cartridge and transmitting the releasing data to the cartridge.

2. The system according to claim 1, wherein the security means is an energy barrier.

3. The system according to claim 1, wherein the device within the cartridge comprises a firing transducer.

4. The system according to claim 3, wherein the firing transducer effects a firing of the cartridge depending on a firing energy supplied over the interface.

5. The system according to claim 3, wherein a firing energy is supplied to the firing transducer depending on the releasing of the security means or an energy barrier.

6. The system according to claim 3, wherein a firing energy is inhibited, blocked and/or passed by the firing transducer by the security means or an energy barrier.

7. The system according to claim 3, wherein the firing transducer can be permanently inactivated by a respective outer impact.

8. The system according to claim 1, wherein the device within the cartridge comprises a memory.

9. The system according to claim 8, wherein the data stored can be at least partially read from the memory.

10. The system according to claim 1, wherein at least the data used for comparing cannot be read from the memory in an unauthorized manner.

11. The system according to claim 1, wherein the apparatus comprises at least one chip or microchip.

12. The system according to claim 1, wherein the apparatus is a percussion cap or is integrated in such.

13. The system according to claim 1, wherein the device is protected against attacks by electrical, mechanical, chemical, thermal energy and/or radiation.

14. The system according to claim 1, wherein the apparatus comprises at least one data interface and/or at least one authentication interface.

15. The system according to claim 1, wherein the apparatus comprises a control.

16. The system according to claim 1, wherein the operating device can be divided such that at least one part of the operating device is assigned to the firearm and/or at least one part of the operating device is assigned to the munitions and/or at least one part of the operating device is assigned to a user.

17. The system according to claim 1, wherein the apparatus comprises a trigger sensor.

18. The system according to claim 1, wherein the apparatus comprises a data memory.

19. The system according to claim 1, wherein the apparatus comprises a firing impulse generator.

20. The system according to claim 1, wherein the authentication interface is a transponder interface and/or a biometric sensor.

21. The system according to claim 1, wherein the operating device and/or the data memory are such formed that data can be stored and/or processed securely against unauthorized reading and manipulation.

* * * * *